US010413810B2

(12) United States Patent
Jiang

(10) Patent No.: US 10,413,810 B2
(45) Date of Patent: Sep. 17, 2019

(54) THREE DIMENSIONAL PUZZLE CUBE

(71) Applicant: Guangzhou Ganyuan Intelligent Technology Co., Ltd., Guangzhou (CN)

(72) Inventor: Ganyuan Jiang, Guangzhou (CN)

(73) Assignee: GUANGZHOU GANYUAN INTELLIGENT TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 16/066,682

(22) PCT Filed: May 30, 2016

(86) PCT No.: PCT/CN2016/083917

§ 371 (c)(1),
(2) Date: Jun. 28, 2018

(87) PCT Pub. No.: WO2017/113578

PCT Pub. Date: Jul. 6, 2017

(65) Prior Publication Data

US 2019/0001218 A1 Jan. 3, 2019

(30) Foreign Application Priority Data

Dec. 29, 2015 (CN) ..... 2015 1 1030863

(51) Int. Cl.
*A63F 9/08* (2006.01)

(52) U.S. Cl.
CPC ..... *A63F 9/0842* (2013.01); *A63F 9/08* (2013.01)

(58) Field of Classification Search
CPC ..... A63F 9/0842; A63F 9/08
See application file for complete search history.

(56) References Cited

U.S. PATENT DOCUMENTS 4,378,117 A * 3/1983 Rubik ..... A63F 9/0834 273/153 S
5,271,688 A * 12/1993 Chang ..... A63F 9/0826 403/290

(Continued)

FOREIGN PATENT DOCUMENTS

CN 201026388 Y 2/2008
CN 202909429 * 5/2013

(Continued)

*Primary Examiner* — Steven B Wong

(57) ABSTRACT

A Rubik's cube includes a plurality of blocks. Each block is spliced from a splicing piece, a central shell and a mounting base, splicing piece is mounted at top of central shell, mounting base is mounted at bottom of central shell; an outer side of central shell forms a friction surface; central shell is provided with a first mating portion, splicing piece is provided with a second mating portion fixedly connected to first mating portion by snap-fitting; bottom of central shell is provided with a third mating portion, mounting base is provided with a fourth mating portion fixedly connected to third mating portion by snap-fitting; a color piece is mounted on splicing piece, an outer side of color piece forms an exhibition surface, color piece is provided with a fifth mating portion, splicing piece is provided with a sixth mating portion fixedly connected to fifth mating portion by snap-fitting.

8 Claims, 3 Drawing Sheets

(56) References Cited

U.S. PATENT DOCUMENTS

| | | | | | |
|---|---|---|---|---|---|
| 5,333,869 | A * | 8/1994 | Hsun | A63F 9/0842 | 273/153 S |
| 5,816,571 | A * | 10/1998 | Chen | A63F 9/0857 | 273/153 S |
| 5,826,871 | A * | 10/1998 | Li | A63F 9/0834 | 273/153 S |
| 5,836,584 | A * | 11/1998 | Chen | A63F 9/0857 | 273/153 S |
| 5,992,850 | A * | 11/1999 | Li | A63F 9/0826 | 273/153 S |
| 6,129,356 | A * | 10/2000 | Li | A63F 9/0842 | 273/153 S |
| 8,342,527 | B2 * | 1/2013 | Wu | A63F 9/0842 | 273/153 S |
| 9,101,822 | B2 * | 8/2015 | Liu | A63F 9/0842 | |
| 2007/0262522 | A1 * | 11/2007 | Lu | A63F 9/0842 | 273/153 S |
| 2009/0127783 | A1 * | 5/2009 | Paquette | A63F 9/0834 | 273/153 S |
| 2015/0076766 | A1 * | 3/2015 | Liu | A63F 9/0826 | 273/153 S |

FOREIGN PATENT DOCUMENTS

| | | | |
|---|---|---|---|
| CN | 202909429 | U | 5/2013 |
| CN | 203861899 | U | 10/2014 |
| CN | 105413156 | A | 3/2016 |
| CN | 205287564 | U | 6/2016 |

* cited by examiner

THREE DIMENSIONAL PUZZLE CUBE

TECHNICAL FIELD

The present invention relates to the technical field of three dimensional puzzle cube structures, and in particular to a three dimensional puzzle cube.

BACKGROUND ART

A three dimensional puzzle cube is generally composed of a plurality of unit blocks and a multidimensional connecting shaft. Taking a traditional third-order three dimensional puzzle cube as an example, the main body thereof is a cube structure comprising twenty-six small blocks and a three-dimensional connecting shaft. The small blocks include six central blocks respectively located at the central positions of the faces of the three dimensional puzzle cube, eight corner blocks located at end corners of the three dimensional puzzle cube, and twelve edge blocks respectively located between two adjacent corner blocks, such that each face of the three dimensional puzzle cube has nine small blocks. Based on the rotating characteristics of the three-dimensional connecting shaft, each layer of the three dimensional puzzle cube can rotate freely. When the three dimensional puzzle cube is assembled, the six central blocks are correspondingly connected to ends of the three-dimensional connecting shaft, and then the corner blocks and the edge blocks are clamped on inner sides of the central blocks so as to prevent the three dimensional puzzle cube from falling apart. In addition, for a colour piece and an edge block of the three dimensional puzzle cube, an exhibition surface is provided on the top, a friction surface is provided on the side, and the bottom is used for connection with the three-dimensional connecting shaft; and the friction surface is used to make a friction with the adjacent edge block, and the exhibition surface is used for mounting a colour piece to distinguish various faces of the three dimensional puzzle cube.

The edge block or corner block structure of the existing three dimensional puzzle cube is generally spliced from two processed symmetric triangular parts, and a splicing joint of the edge block or corner block structure processed in such a way is located on the friction surface with the adjacent block, which causes that the three dimensional puzzle cube does not rotate smoothly enough and thus requires some time to fit in. In addition, the colour piece in the existing three dimensional puzzle cube is made by directly affixing a colour sticker on a block, and after being used for a period of time, the sticker easily falls off, thereby causing that the three dimensional puzzle cube is not durable.

SUMMARY OF THE INVENTION

In view of the deficiencies of the prior art, the object of the present invention is to provide a three dimensional puzzle cube, which has a plurality of blocks, with all splicing joints being on non-contact friction surfaces, so that the three dimensional puzzle cube can rotate smoothly without fitting-in; and a colour piece thereof is fixed by means of snap-fitting, is not easy to fall off, and is durable.

In order to achieve the object mentioned above, the following technical solution is used in the present invention:

a three dimensional puzzle cube, comprising a plurality of blocks, wherein each of the blocks is spliced from a splicing piece, a central shell and a mounting base, the splicing piece is mounted at the top of the central shell, and the mounting base is mounted at the bottom of the central shell; an outer side of the central shell forms a friction surface; the central shell is provided with a first mating portion, and the splicing piece is provided with a second mating portion, the second mating portion being fixedly connected to the first mating portion by means of snap-fitting; the bottom of the central shell is provided with a third mating portion, and the mounting base is provided with a fourth mating portion, the fourth mating portion being fixedly connected to the third mating portion by means of snap-fitting; and a colour piece is mounted on the splicing piece, an outer side of the colour piece forms an exhibition surface, the colour piece is provided with a fifth mating portion, and the splicing pieces is provided with a sixth mating portion, the sixth mating portion being fixedly connected to the fifth mating portion by means of snap-fitting.

Preferably, the first mating portion is a first slot provided on an inner wall of the central shell, and the second mating portion is a first hook snap-fitted in the first slot.

Preferably, the third mating portion is a second slot provided on the bottom of the central shell, the fourth mating portion is a second hook provided on the mounting base, and the second hook is configured to pass into the central shell and be snap-fitted in the second slot.

Preferably, two second slots are provided, and the two second slots are symmetrically distributed about the central axis of the central shell; and a second hook is snap-fitted in each of the two second slots.

Preferably, the third mating portion is a boss extending from the bottom of the central shell toward the interior of the central shell, the boss has a hollow, and the top of the boss is provided with a third slot; and the fourth mating portion is a post, the top of the post is provided with a third hook, and the post is inserted into the hollow, and the third hook passes through the third slot and is snap-fitted to the top of the boss.

Preferably, three third slots and three third hooks are provided; and both the boss and the post have a regular triangle-shaped cross-section, the three third slots are respectively located at three corners of the regular triangle-shaped boss, and the three third hooks are respectively located at three corners of the regular triangle-shaped post.

Preferably, the fifth mating portion is a fourth hook, and the sixth mating portion is a fourth slot, the fourth hook being snap-fitted in the fourth slot.

Preferably, the colour piece protrudes from an outer side end surface of the splicing piece and forms a protrusion, and an edge of the protrusion is arc-shaped.

Preferably, the central shell is internally provided with a positioning hole, and the splicing piece is provided with a positioning column, the positioning column being inserted into the positioning hole.

Preferably, a plurality of positioning holes are provided, the plurality of positioning holes are symmetrically distributed on inner side walls of the central shell about the central axis of the central shell, and each of the positioning holes has the positioning column inserted therein.

The beneficial effects of the present invention lie in:

compared with the prior art, the three dimensional puzzle cube of the present invention has a plurality of blocks, wherein each of the blocks is spliced from a splicing piece, a central shell and a mounting base, the splicing piece and the mounting base are mounted at the top and the bottom of the central shell, and splicing joints are all on non-contact friction surfaces, so that the blocks can rotate smoothly relative to each other without fitting-in; moreover, the parts are fixed by means of snap-fitting so as to improve the mounting accuracy, and the connection structure is firm and reliable, which can effectively prevent the parts from loosening from each other; and in addition, the colour piece is fixed to the block by means of snap-fitting, and the connection structure is firm, so that the colour piece is not easy to fall off and is durable.

Figure 1:
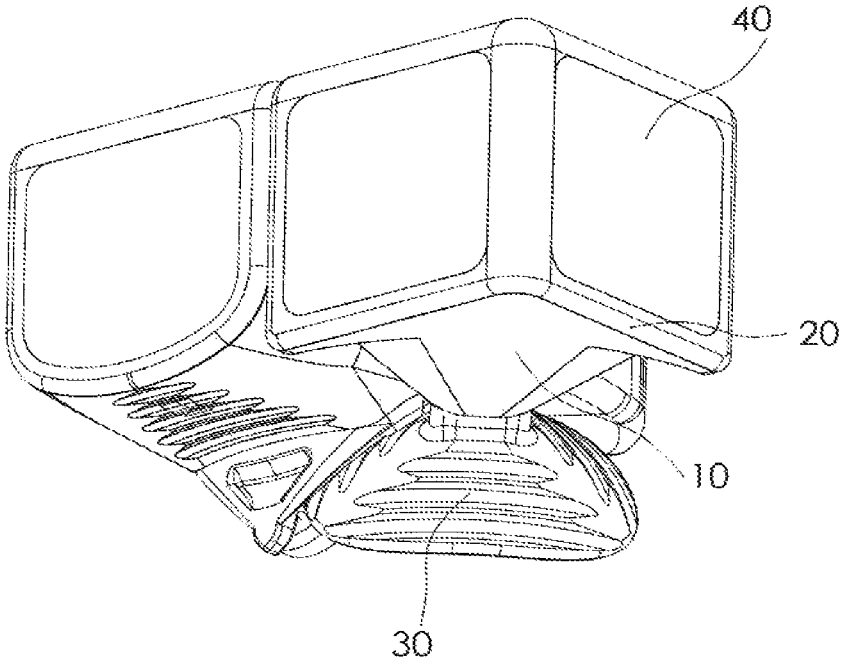
FIG. 1 is a structural schematic diagram of the present invention.
Figure 2:
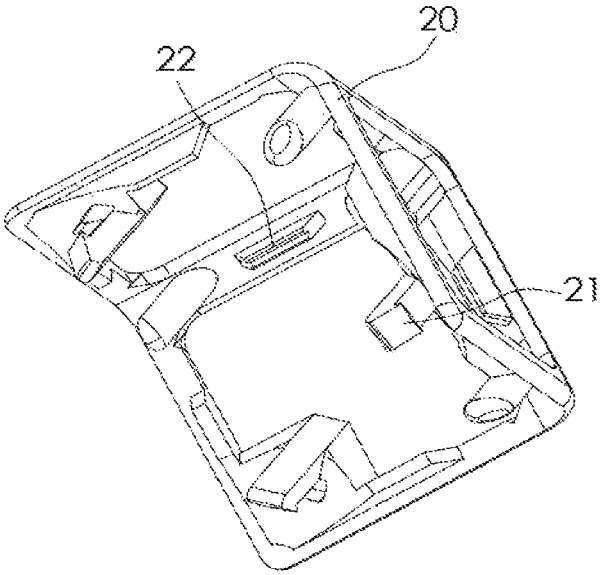
FIG. 2 is a structural schematic diagram of a splicing piece of the present invention.
Figure 3:
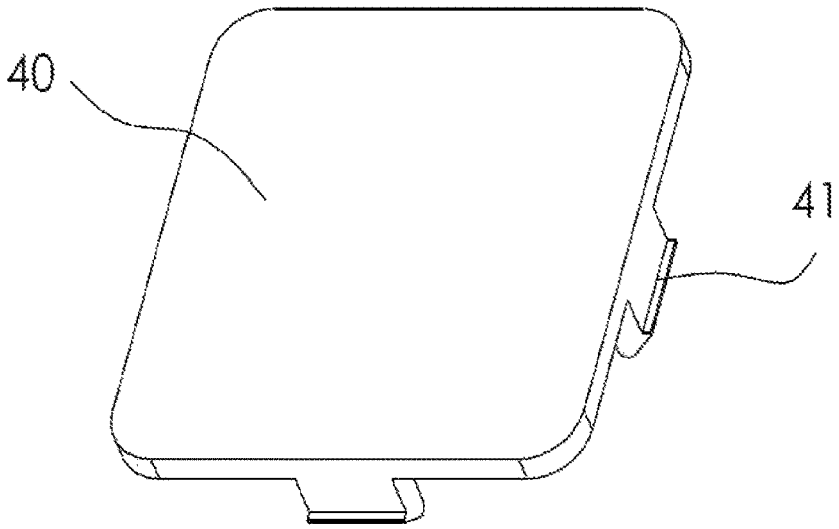
FIG. 3 is a structural schematic diagram of a colour piece of the present invention.
Figure 4:
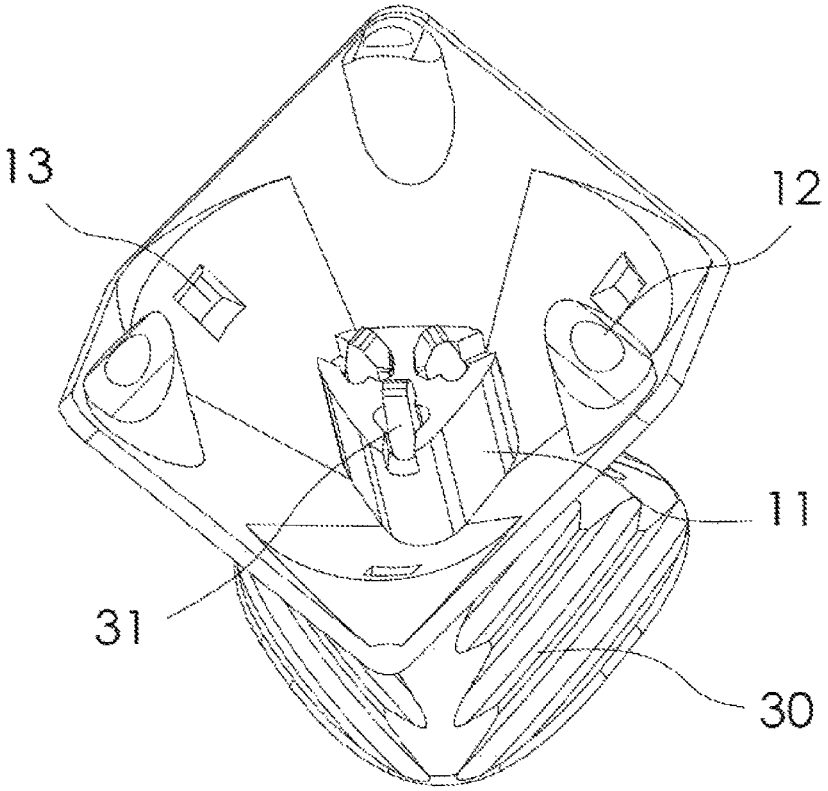
FIG. 4 is a partial structural schematic diagram of the present invention.

In the figures: 10. central shell; 11. boss; 12. positioning hole; 13. first slot; 10'. central shell; 12'. positioning hole; 13'. first slot; 20. splicing piece; 21. first hook; 22. fourth slot; 30. mounting base; 30'. mounting base; 31. third hook; 31'. second hook; 40. colour piece; 41. fourth hook.

DETAILED DESCRIPTION OF EMBODIMENTS

The present invention will be further described below in conjunction with the drawings and the particular embodiments.

A three dimensional puzzle cube, as shown in FIGS. 1-4, comprises a plurality of blocks, and each of the blocks is spliced from a central shell 10, a splicing piece 20 and a mounting base 30 and can be used as an edge block or a corner block of the three dimensional puzzle cube; in addition, the splicing piece 20 mentioned above is mounted at the top of the central shell 10, and the mounting base 30 is mounted at the bottom of the central shell 10, and at the same time, an outer side of the central shell 10 may form a friction surface to come into contact with an adjacent edge block or corner block of the three dimensional puzzle cube; and moreover, a colour piece 40 is mounted on an outer side of the splicing piece 20, and an outer side of the colour piece 40 may form an exhibition surface. On the basis of the structure mentioned above, the splicing joints of the formed edge block or corner block are all on non-contact friction surfaces, so that the blocks can rotate smoothly relative to each other without fitting-in. Thus, the three dimensional puzzle cube formed by the plurality of blocks mentioned above can rotate smoothly without fitting-in.

Specifically, the central shell 10 is provided with a first mating portion, and the splicing piece 20 is provided with a second mating portion, the second mating portion being fixedly connected to the first mating portion by means of snap-fitting to achieve the fixation between the splicing piece 20 and the central shell 10. In addition, a third mating portion is provided at the bottom of the central shell 10, and the corresponding mounting base 30 is provided with a fourth mating portion, the fourth mating portion being likewise fixedly connected to the third mating portion by means of snap-fitting to achieve the fixation between the central shell 10 and the mounting base 30. In addition, the colour piece 40 mentioned above is provided with a fifth mating portion, and the splicing piece 20 is provided with a sixth mating portion, the sixth mating portion being fixedly connected to the fifth mating portion by means of snap-fitting to achieve the fixation between the colour piece 40 and the splicing piece 20. On the basis of the structure mentioned above, the parts are fixed by means of snap-fitting so as to improve the mounting accuracy, and the connection structure is firm and reliable, which can effectively prevent the parts from loosening from each other.

Specifically, in this embodiment, the first mating portion mentioned above may be a first slot 13 provided on an inner wall of the central shell 10, and accordingly, the second mating portion is a first hook 21 snap-fitted in the first slot 13, thus achieving the snap-fitting and fixation between the central shell 10 and the splicing piece 20.

Moreover, the third mating portion is a boss 11, the boss 11 extends from the bottom of the central shell 10 toward the interior of the central shell 10, the boss 11 has a hollow, and a third slot is provided at the top of the boss 11. The fourth mating portion is a post, and a third hook 31 is provided at the top of the post, such that when the mounting base 30 is assembled at the bottom of the central shell 10, the post can be inserted into the hollow of the boss 11, thus achieving the positioning and a higher mounting accuracy. At the same time, the third hook 31 mentioned above passes through the third slot and is snap-fitted at the top of the boss 11, so that the mounting base 30 is snap-fitted and fixed to the central shell 10, and this fixing structure is used in corner blocks of the present three dimensional puzzle cube.

Meanwhile, the fifth mating portion is a fourth hook 41, and the sixth mating portion is a fourth slot 22, the fourth hook 41 being snap-fitted in the fourth slot 22 to achieve the snap-fitting and fixation between the colour piece 40 and the splicing piece 20.

Of course, the snap-fitting and fixation between the parts are achieved by means of the hook and the slot as mentioned above, and the positions of the hooks and the slots are combined corresponding to the positions of the respective mating portions mentioned above.

Preferably, the cross section of the boss 11 and the post mentioned above may specifically be regular triangle-shaped, the number of the slots and the hooks mentioned above may be specifically three, the three third slots are respectively located at three corners of the regular triangle-shaped boss 11, the three third hooks 31 are respectively located at three corners of the regular triangle-shaped post, and meanwhile the central axis of the boss 11 mentioned above may coincide with the central axis of the central shell 10', 10. Thus, on the basis of the structure mentioned above, the parts in the corner block are all centrosymmetric, which can achieve consistent dimensions in all directions, uniform friction, and constant hand feel.

Preferably, the colour piece 40 mentioned above may also protrude from an outer side end surface of the splicing piece 20, and the protrusion of the colour piece 40 may cover the splicing joint between the colour piece 40 and the splicing piece 20 from a side view, which makes the surface of the three dimensional puzzle cube look smoother and does not affect the appearance and touch feel. Of course, the portion of the colour piece 40 protruding from the exhibition surface may form a protrusion, and the edge of the protrusion is arc-shaped, which makes the surface structure of the three dimensional puzzle cube look smoother and achieves a better hand feel.

Preferably, the central shell 10 mentioned above may also be internally provided with a positioning hole 12, accordingly the splicing piece 20 is provided with a positioning column, the positioning column is inserted into the positioning hole 12, and when the splicing piece 20 is mounted, the positioning column may be firstly inserted into the positioning hole 12 to complete positioning, and then the first hook 21 is snap-fitted in the first slot 13 to achieve a more accurate mounting position. Moreover, a plurality of positioning holes 12 may also be provided, the plurality of positioning holes 12 may be symmetrically distributed on inner side walls of the central shell 10 about the central axis of the central shell 10, and the positioning column mentioned above may also be inserted into the positioning hole 12, so as to make the mounting structure of the parts centrosymmetric, thus the three dimensional puzzle cube achieves consistent dimensions in all directions, uniform friction, and constant hand feel.

Figure 5:
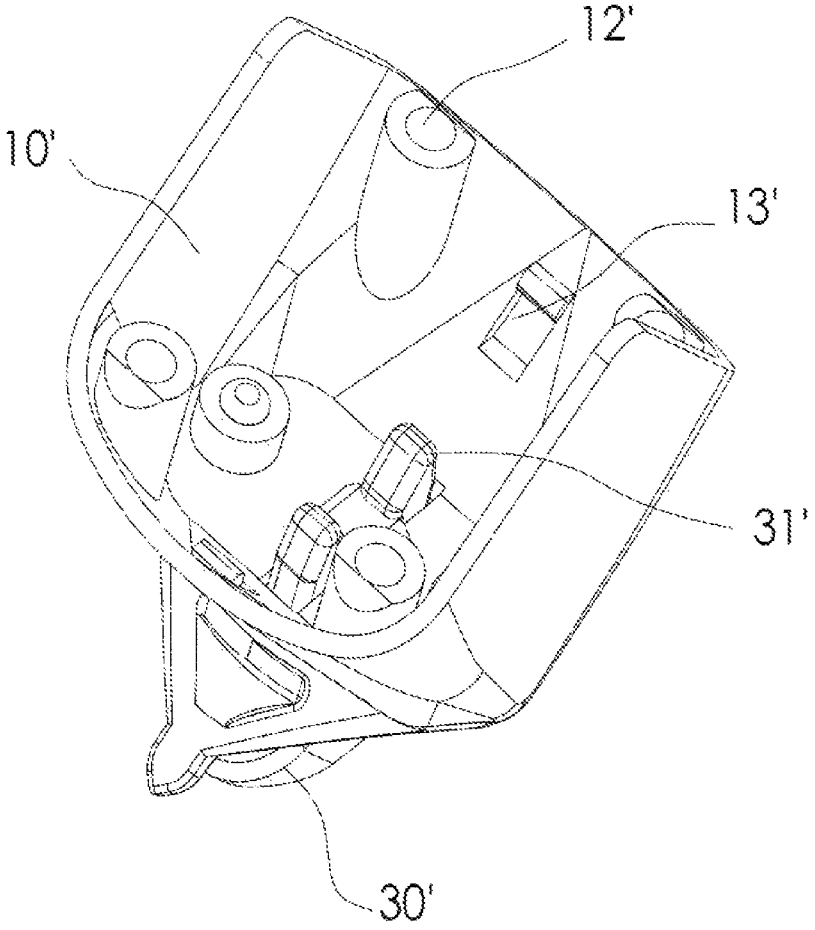
FIG. 5 is another partial structural schematic diagram of the present invention.

In addition, in other cases, as shown in FIG. 5, the third mating portion mentioned above is a second slot provided on the bottom of the central shell 10', the fourth mating portion is a second hook 31' provided on the mounting base 30', the second hook 31' is configured to pass into the central shell 10' and to be snap-fitted in the second slot, so as to achieve the snap-fitting and fixation between the splicing piece 20 and the mounting base 30'. The structure can be used for the fixation between the splicing piece 20 and the mounting base 30' in the edge block of the three dimensional puzzle cube. Further, two second slots are provided, and the two second slots are symmetrically distributed about the central axis of the central shell 10'; and a second hook 31' is snap-fitted in each of the two second slots, so as to make the mounting structure of the parts centrosymmetric, thus the three dimensional puzzle cube has consistent dimensions in all directions. Of course, the central shell in this structure is also provided with the positioning hole 12' mentioned above and the first slot 13' so as to facilitate the mounting of the splicing piece.

For a person skilled in the art, a variety of other corresponding modifications and variations can be made according to the above-described technical solutions and concepts, and all the modifications and variations shall fall within the scope of protection of the claims of the present invention.

The invention claimed is:

1. A three dimensional puzzle cube, comprising a plurality of blocks, wherein, each block is spliced from a splicing piece, a central shell and a mounting base, the splicing piece is mounted at a top of the central shell, and the mounting base is mounted at a bottom of the central shell; an outer side of the central shell forms a friction surface; the central shell is provided with a first mating portion, and the splicing piece is provided with a second mating portion, the second mating portion being fixedly connected to the first mating portion by snap-fitting; the bottom of the central shell is provided with a third mating portion, and the mounting base is provided with a fourth mating portion, the fourth mating portion being fixedly connected to the third mating portion by snap-fitting; and a colour piece is mounted on the splicing piece, an outer side of the colour piece forms an exhibition surface, the colour piece is provided with a fifth mating portion, and the splicing piece is provided with a sixth mating portion, the sixth mating portion being fixedly connected to the fifth mating portion by snap-fitting; the central shell is internally provided with a plurality of positioning holes, the plurality of positioning holes are symmetrically distributed on inner side walls of the central shell about the central axis of the central shell, and the splicing piece is provided with a plurality of positioning columns, wherein each of the positioning holes has one positioning column inserted therein.

2. The three dimensional puzzle cube of claim 1, wherein the first mating portion is a first slot provided an inner wall of the central shell, and the second mating portion is a first hook snap-fitted in the first slot.

3. The three dimensional puzzle cube of claim 1, wherein the third mating portion is a second slot provided on the bottom of the central shell, the fourth mating portion is a second hook provided on the mounting base, and the second hook is configured to pass into the central shell and be snap-fitted in the second slot.

4. The three dimensional puzzle cube of claim 3, further comprising two second slots symmetrically distributed about a central axis of the central shell; and a second hook snap-fitted in each of the two second slots.

5. The three dimensional puzzle cube of claim 1, wherein the third mating portion is a boss extending from the bottom of the central shell toward the interior of the central shell, the boss is hollow, and a top of the boss is provided with at least one third slot; and the fourth mating portion is a post, a top of the post is provided with at least one third hook, and the post is inserted into the hollow boss, and the at least one third hook passes through the at least one third slot and is snap-fitted to the top of the boss.

6. The three dimensional puzzle cube of claim 5, wherein the boss has three third slots and three third hooks; and both the boss and the post have a regular triangle-shaped cross-section, the three third slots are respectively located at three corners of the regular triangle-shaped boss, and the three third hooks are respectively located at three corners of the regular triangle shaped post.

7. The three dimensional puzzle cube of claim 1, wherein the fifth mating portion is a fourth hook, and the sixth mating portion is a fourth slot, the fourth hook being snap-fitted in the fourth slot.

8. The three dimensional puzzle cube of claim 1, wherein the colour piece protrudes from an outer side end surface of the splicing piece and forms a protrusion, and an edge of the protrusion is arc-shaped.

* * * * *